US009837229B2

(12) United States Patent
Chaly et al.

(10) Patent No.: US 9,837,229 B2
(45) Date of Patent: Dec. 5, 2017

(54) METHOD AND APPARATUS FOR CONTROLLING CIRCUIT BREAKER OPERATION

(75) Inventors: Alexey Chaly, Moscow (RU); Vladimir Ledyaev, Sevastopol (UA)

(73) Assignee: Tavrida Electric Holding AG, Cham (CH)

( * ) Notice: Subject to any disclaimer, the term of this patent is extended or adjusted under 35 U.S.C. 154(b) by 414 days.

(21) Appl. No.: 13/168,035

(22) Filed: Jun. 24, 2011

(65) Prior Publication Data

US 2012/0327549 A1 Dec. 27, 2012

(51) Int. Cl.

| | |
|---|---|
| ***H01H 47/00*** | (2006.01) |
| ***H01H 33/666*** | (2006.01) |
| ***H01H 47/32*** | (2006.01) |
| *H01F 7/18* | (2006.01) |
| *H01H 33/38* | (2006.01) |
| *H01H 47/22* | (2006.01) |

(52) U.S. Cl.
CPC ..... *H01H 33/6662* (2013.01); *H01H 47/325* (2013.01); *H01F 7/1872* (2013.01); *H01H 33/38* (2013.01); *H01H 47/226* (2013.01)

(58) Field of Classification Search
USPC ..... 361/160, 154, 155
See application file for complete search history.

(56) References Cited

U.S. PATENT DOCUMENTS

| | | | | |
|---|---|---|---|---|
| 5,128,825 | A * | 7/1992 | Hurley et al. | 361/154 |
| 5,917,692 | A * | 6/1999 | Schmitz et al. | 361/187 |
| 6,236,552 | B1 * | 5/2001 | Hattori | 361/160 |
| 6,845,001 | B1 * | 1/2005 | Kinbara | H01F 7/1844 361/152 |
| 2004/0201943 | A1 * | 10/2004 | Takeuchi et al. | 361/139 |
| 2006/0007623 | A1 | 1/2006 | Trivette | |
| 2006/0221534 | A1 * | 10/2006 | Oide | H01H 47/325 361/160 |
| 2009/0200270 | A1 * | 8/2009 | Chen et al. | 218/119 |
| 2009/0262479 | A1 * | 10/2009 | Yang | F02D 41/20 361/154 |
| 2010/0008009 | A1 | 1/2010 | Cartier-Millon et al. | |
| 2012/0327549 | A1 * | 12/2012 | Chaly | H01H 47/325 361/160 |

FOREIGN PATENT DOCUMENTS

| | | | |
|---|---|---|---|
| DE | 19530121 | A1 * | 2/1997 |
| EP | 0 440 498 | A2 | 8/1991 |
| JP | 2010 092746 | A | 4/2010 |

OTHER PUBLICATIONS

European Search Report dated Sep. 27, 2012 in corresponding European Patent Application No. 12004657.8, filed Jun. 21, 2012.

* cited by examiner

*Primary Examiner* — Ronald W Leja
(74) *Attorney, Agent, or Firm* — Chapin IP Law, LLC

(57) ABSTRACT

A method of controlling a circuit breaker that has a movable contact and an actuator for moving the movable contact between an open position and a closed position. With the movable contact in the open position, a voltage is applied to the actuator to cause the movable contact to move towards the closed position. The voltage is applied for a limited time period ending before the movable contact reaches the closed position. At the end of the limited time period, the voltage is adjusted to reduce the acceleration exerted on the contact. The voltage is subsequently increased just before, after, or substantially at the same time as the contact reaches its closed position.

33 Claims, 7 Drawing Sheets

METHOD AND APPARATUS FOR CONTROLLING CIRCUIT BREAKER OPERATION

FIELD OF THE INVENTION

The present invention relates to the operation of electrical switches, especially circuit breakers.

BACKGROUND TO THE INVENTION

Circuit breakers, including reclosers, typically comprise an electromagnetic actuator for moving an electrical contact between open and closed states. Closing the actuator usually involves energising one or more electromagnetic coils to move the contact against a mechanical bias such as a spring. In order to preserve the mechanical life of the circuit breaker, the speed at which the contact moves should be restricted. This adversely affects the efficiency of the actuator, resulting in increased weight size and power consumption for the circuit breaker.

It would be desirable to provide an improved method for controlling the operation of circuit breakers that mitigates the problem outlined above.

SUMMARY OF THE INVENTION

A first aspect of the invention provides a method of controlling an electrical switch, the electrical switch comprising a movable contact and an electromagnetic actuator for causing said movable contact to move between an open position and a closed position, said method comprising:

with said movable contact in said open position, applying a voltage to said actuator to cause a motive force to be applied to said movable contact to cause said movable contact to move towards said closed position, wherein said voltage is applied for a first time period ending before said movable contact reaches said closed position, and at the end of said first time period, adjusting said voltage to reduce said motive force.

In typical embodiments, said method further includes, after said voltage is adjusted to reduce said motive force, further adjusting said voltage to increase said motive force. Said further adjusting of said voltage is preferably performed before said movable contact reaches said closed position, especially immediately before said movable contact reaches said closed position. In particular, it is preferred that said further adjusting of said voltage is performed sufficiently close to the moment when said movable contact reaches said closed position that said further voltage adjusting does not appreciably affect the speed of said movable contact. For example, said further adjusting of said voltage may be performed up to 2 ms, preferably up to 1 ms, and more preferably up to 0.5 ms, before said movable contact reaches said closed position. Said further adjusting of said voltage may be performed substantially at the same time as said movable contact reaches said closed position.

Optionally, said adjusting said voltage to reduce said motive force involves reducing said voltage to a non-zero level. Said adjusting said voltage to reduce said motive force may involve reducing said voltage by at least approximately 50% to a non-zero level.

Alternatively, said adjusting said voltage to reduce said motive force involves reducing said voltage to zero.

Alternatively still, said adjusting said voltage to reduce said motive force involves reversing the polarity of said voltage.

Alternatively, said adjusting said voltage to reduce said motive force involves modulating said voltage. Said adjusting said voltage to reduce said motive force may involve pulse width modulating said voltage. Said pulse width modulation may be arranged to cause zero volts to be applied to said actuator between pulses.

In typical embodiments, said switch includes a control circuit, said control circuit including at least one capacitor for storing said voltage, and wherein said applying a voltage to said actuator to cause a motive force to be applied to said movable contact involves applying said voltage from said at least one capacitor to said actuator. Adjusting said voltage to reduce said motive force may therefore involve adjusting said voltage applied from said at least one capacitor to said actuator.

In preferred embodiments, said actuator comprises at least one electromagnetic coil, and wherein said applying a voltage to said actuator to cause a motive force to be applied to said movable contact involves applying said voltage to said at least one coil. Typically adjusting said voltage to reduce said motive force involves adjusting said voltage applied to said at least one coil.

From a second aspect the invention provides an electrical switch comprising a movable contact and an electromagnetic actuator for causing said movable contact to move between an open position and a closed position, said switch further comprising a voltage source, a controller for selectably applying voltage from said voltage source to said actuator, wherein said controller is arranged to, with said movable contact in said open position, cause a voltage to be applied to said actuator from said voltage source to cause a motive force to be applied to said movable contact to cause said movable contact to move towards said closed position, and wherein said controller is arranged to apply said voltage for a first time period ending before said movable contact reaches said closed position, and wherein said controller is further arranged to, at the end of said first time period, adjust said voltage to reduce said motive force.

Preferably, said voltage source comprises at least one capacitor.

Typically, said actuator comprises at least one electromagnetic coil, said controller being arranged to selectably apply voltage to said at least one electromagnetic coil.

Said actuator may include a movable part movable into and out of a closed position in response to changes in the energization of said at least one electromagnetic coil. Preferably, said actuator includes a non-movable part, and wherein said movable and non-movable parts are configured to latch magnetically with one another in a closed position as a result of residual magnetism of said movable and non-movable parts (said residual magnetism resulting from the prior effect of said at least one coil when energised (i.e. by the flow of current) on said movable and non-movable parts).

Said electrical switch may comprise a circuit breaker or a vacuum interrupter.

Further advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
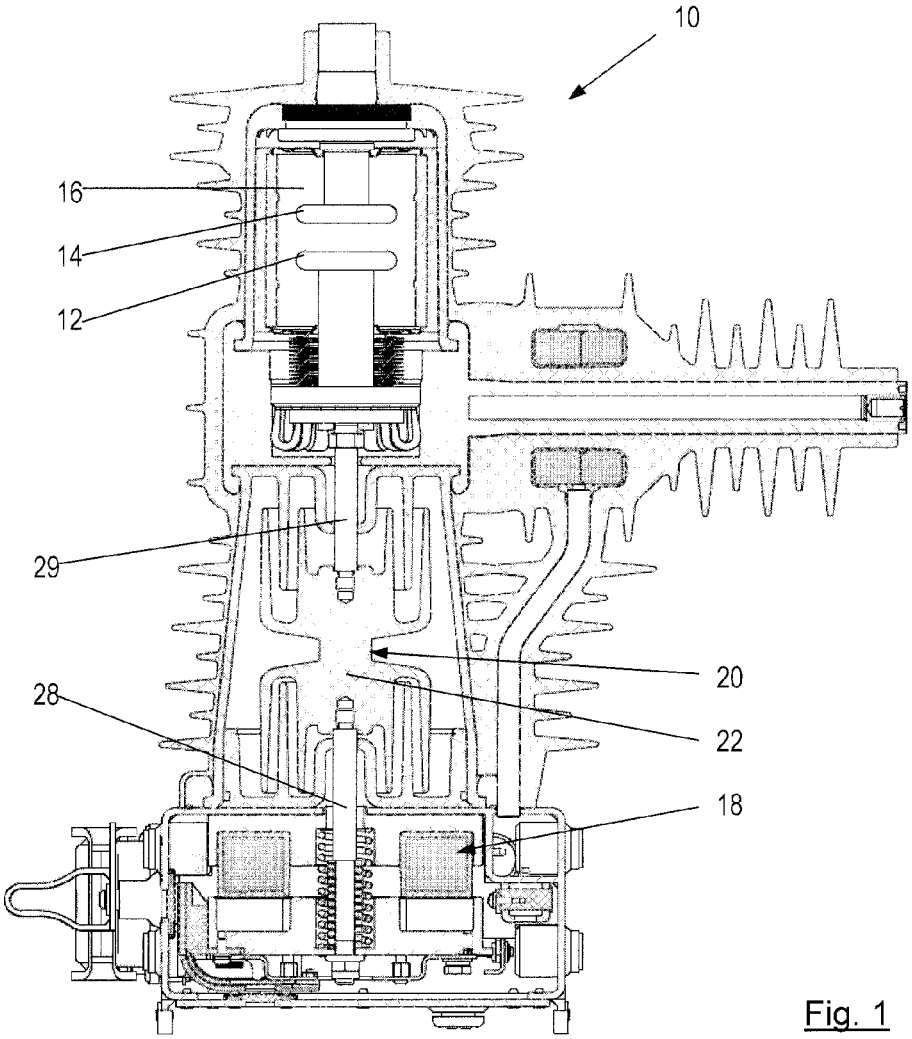
FIG. 1 is a sectioned side view of a circuit breaker suitable for use with the present invention.

Referring now in particular to FIG. 1 of the drawings, there is shown, generally indicated as 10 an electrical switch device of a type commonly referred to as a circuit breaker or interrupter. The switch 10 is configured to operate automatically in a fault condition, e.g. a current overload or short circuit, to protect the circuit (not shown) into which it is incorporated during use. It achieves this by breaking the electrical circuit in response to detecting a fault, thereby interrupting current flow. In some embodiments, the switch 10 can be reset manually (e.g. mechanically or electro-mechanically by manual activation of a user control (not shown)) or automatically (typically electro-mechanically in response to the switch 10 detecting that the fault has gone, and/or after a threshold period of time has expired since activation). Circuit breakers that reset automatically are commonly known as reclosers.

The switch 10, which is hereinafter referred to as a circuit breaker, comprises first and second electrical contacts 12, 14. The first contact 12 is movable between an open position (as shown in FIG. 1) and a closed position (not illustrated) in which it makes electrical contact with the second contact 14. The open position of the contact 12 corresponds to the open, or breaking, state of the circuit breaker 10 in which it interrupts current flow. The closed position of the contact 12 corresponds to the closed, or making, state of the circuit breaker 10 in which current is able to flow between the contacts 12, 14.

In the illustrated embodiment, the contacts 12, 14 are located in a vacuum chamber 16 and the circuit breaker 10 may be referred to as a vacuum circuit breaker.

Movement of the contact 12 between its open and closed positions is effected by an electromagnetic actuator 18, which is described in further detail hereinafter with reference to FIGS. 2 and 3. To this end, the actuator 18 is mechanically coupled to the movable contact 12. In the illustrated embodiment, a mechanical coupling device 20 is provided between the actuator 18 and the contact 12 and is configured to translate movement of the actuator 18 into a corresponding movement of the contact 12. In particular, the coupling device 20 translates substantially linear movement of the actuator 18 into substantially linear movement of the contact 12. Preferably, the coupling device 20 comprises a coupling member 22 formed from an electrically insulating material.

Figure 2:
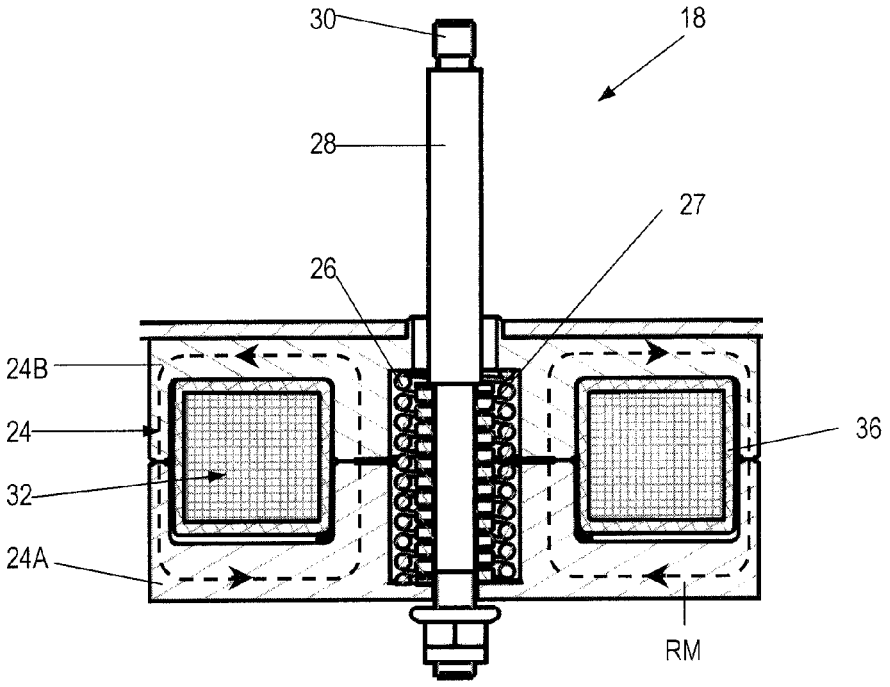
FIG. 2 is a sectioned side view of an actuator suitable for use in the circuit breaker of FIG. 1, the actuator being shown in a closed state.
Figure 3:
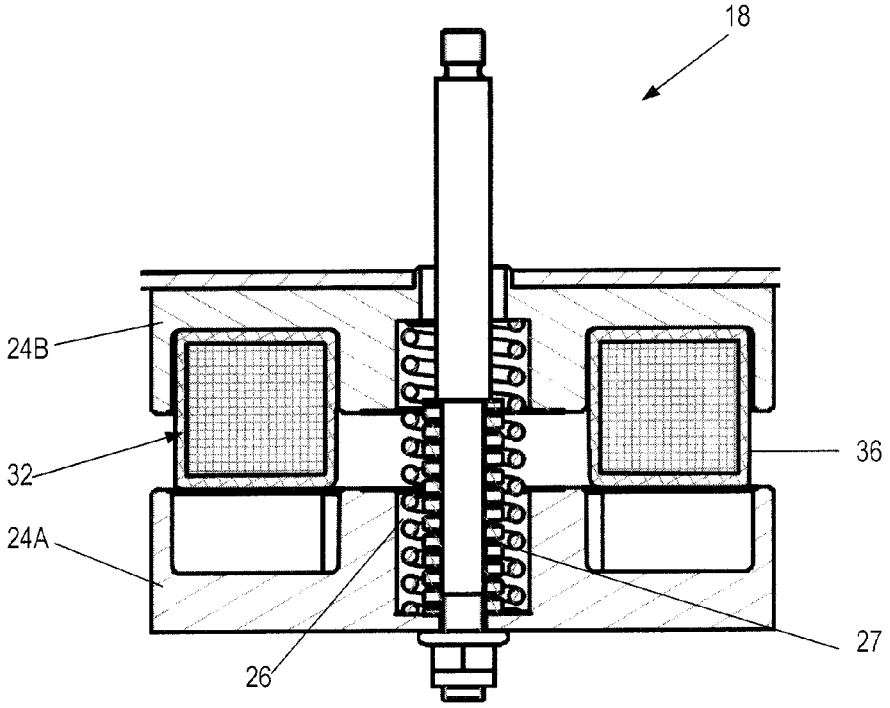
FIG. 3 is a side sectioned view of the actuator of FIG. 2, the actuator being shown in an open state.

Referring now to FIGS. 2 and 3, the preferred actuator 18 is described. The actuator 18 comprises a body 24 having a first part 24A and a second part 24B. The first part 24A is movable with respect to the second part 24B between a closed position (FIG. 2) and an open position (FIG. 3), the second part 24B typically being fixed with respect to the circuit breaker 10 during use. Resilient biasing means are provided to urge the first part 24A towards and preferably into the open position. In typical embodiments, the resilient biasing means is arranged to urge the first part 24A into the open position, and may comprise any suitable resilient biasing device, e.g. one or more compression springs 26.

The actuator 18 comprises a stem 28 which conveniently carries the spring 26. In the illustrated embodiment, the free end 30 of the stem 28 is coupled to the coupling member 22. In use, as part 24A moves towards part 24B, it causes rod 30 to move upwardly (as viewed in the drawings). Corresponding movement is imparted to a second stem 29 via the coupling member 22, the second stem 29 being coupled between the coupling member 22 and the movable contact 12. This movement of the second stem 29 causes the contact 12 to move towards and ultimately into the closed position. Resilient biasing means, for example comprising one or more compression springs 27, may be coupled between the movable part 24A and the stem 28. The preferred arrangement is such that, when the part 24A is in its closed position, spring 27 is compressed and so imparts force to the stem 28 to help maintain contact 12 in its closed position.

Hence, movement of the part 24A towards its closed position causes movement of the contact 12 towards its closed position. It is noted that the part 24A and contact 12 may not reach their respective closed positions at the same time. For example, in the illustrated embodiment, contact 12 reaches its closed position before part 24A does. The preferred arrangement is such that the movement of the part 24A that occurs after contact 12 is closed serves to compress spring 27.

The actuator 18 includes an electromagnetic operating device 32 comprising one or more electromagnetic coil 36 (which may comprising one or more windings), and typically a coil holder. The coil 36 is typically annular and is shown in FIGS. 2 and 3 in cross section. The coil 36 is typically configured to form a solenoid. The coil 36 is energised by applying a voltage to it causing current to flow through the coil, the current creating an electromagnetic field around the coil. Conversely, the coil 36 is de-energised by reducing the current flowing through the coil 36. The arrangement is such that, when energised, the coil 36 acts as an electromagnet that urges the movable part 24A towards the closed position and also, in preferred embodiments, magnetises the parts 24A, 24B to create latching residual magnetism between them.

In the preferred embodiment, a solid core is not present within the coil 36. However, movable part 24A may be regarded as an electromagnetic core for the coil 36, while non-movable part 24B may be regarded as a yoke. Typically, parts 24A, 24B are formed at least partly from magnetisable, or ferromagnetic, material that is non-permanently magnetised but is susceptible of being magnetised by the electromagnetic field generated in use by the coil 36. Alternatively, one or both of parts 24A, 24B may be formed at least partly from permanently magnetised material.

The coil 36 is carried by, typically fixed to, one of the parts 24A, 24B, in this example the second part 24B. The preferred arrangement is that the coil 36 projects from the second part 24B and the first part 24B is shaped to receive the projecting portion of the coil 36 when the parts 24A, 24B are together. The first part 24A may be held in the closed position by one or more of a variety of ways depending on the embodiment. For example, where one or both of the first or second parts 24A, 24B comprises a permanent magnet, or is otherwise formed at least partly from magnetisable material, the first part 24A may be held closed by residual magnetism (indicated by magnetic flux lines RM in FIG. 2) in the first and/or second parts 24A, 24B. Alternatively, or in addition, the coil 36 may remain energised to hold the first part 24A in the closed position by electromagnetic force created by the electromagnetic field around the coil. In the illustrated embodiment, the coil 36 creates residual magnetism in the first and second parts 24A, 24B such that, when the coil 36 is subsequently de-energised, the first and second parts 24A, 24B are held together.

The coil 36 may be operated to release the first part 24A by controlling the voltage applied to the coil 36, and in particular by controlling the current flowing in the coil. For example, in embodiments where the coil 36 is energised to maintain the latching state by electromagnetism, the coil 36 may be released by de-energising the coil 36 (i.e. reducing the current flowing in the coil). In preferred embodiments, a suitable voltage may be applied to the coil 36 resulting in an electromagnetic field that has the effect of overcoming or cancelling any residual magnetism (including permanent magnetism) that is maintaining the latched state. Conveniently, this is achieved by applying a voltage to the coil with opposite polarity to the voltage used to close the actuator 18.

When the coil 36 is operated as described above (i.e. when the first and second parts 24A, 24B are de-magnetised), the spring 26 actuates the first part 24A of the body into its open position (FIG. 3). Returning the first part 24A to the closed position can be achieved by energising the coil 36 with a voltage suitable for creating an electromagnetic field around the coil 36 that has the effect of drawing the first part 24A into its closed position (and such that the bias of spring 26 is overcome). Movement of the first part 24A towards its open position causes movement of the contact 12 towards its open position. In the illustrated embodiment, an initial movement of the part 24A out of its closed position causes decompression of spring 27 and no movement of contact 12. Subsequently, contact 12 moves towards its open position as the part 24 continues to move towards its open position.

Figure 4:
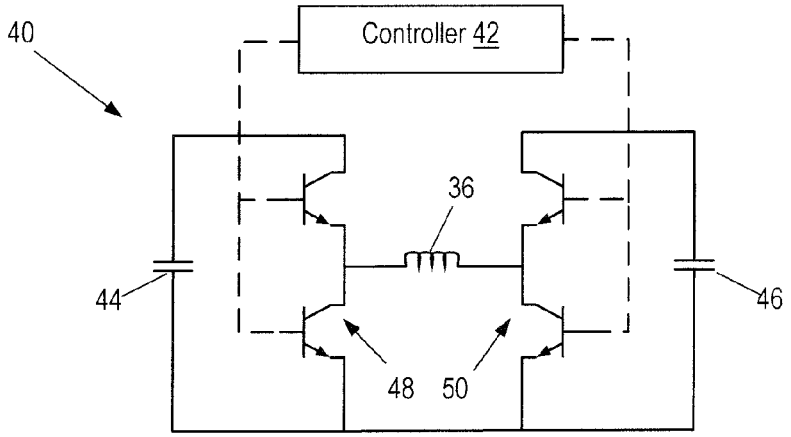
FIG. 4 is a schematic view of a control circuit suitable for use in controlling the operation of the circuit breaker of FIG. 1.

Referring now to FIG. 4, there is shown a control circuit 40 for controlling the operation of the actuator 18, and so controlling operation of the circuit breaker 10. The circuit 40 is electrically connected to the, or each, electromagnetic coil 36 and is configured to control the energisation of the coil 36, i.e. by controlling the voltage across the coil and thus the current though the coil. The circuit 40 includes a controller 42 arranged to detect a fault condition and to energise or de-energise the coil 36 accordingly. The controller 42 may take any suitable form, e.g. comprising logic circuitry, and PLC (programmable logic controller) and/or a suitably programmed microprocessor or microcontroller. The controller 42 may be coupled to any suitable fault detection device, e.g. a current monitor.

In a simple embodiment (not illustrated), the control circuit may be arranged to apply an energising voltage to the coil 36 when it is desired to close the actuator 18 or keep it closed (i.e. keep the parts 24A, 24B magnetised), and to de-energise the coil 36, e.g. cut or reduce the voltage, when it is desired to open the actuator 18 (wherein the parts 24A, 24B are such that residual magnetism does not continue to hold them together).

In preferred embodiments, however, where the coil 36 is held in its latching state by residual magnetism, the control circuit 40 is configured to respectively apply a voltage to the coil 36 to open the actuator 18 and to close the actuator 18. When opening the actuator 18, the applied voltage is selected such that it has the effect of de-magnetising the first and second parts 24A, 24B of the actuator as described above. When closing the actuator, the applied voltage is selected such that the coil 36 creates an electromagnetic field causing the first part 24A to be drawn to the closed position (overcoming the bias of the spring 26), i.e. the energised coil 36 creates a motive force acting on the movable part 24A of the actuator, causing the movable part 24A to move towards the closed position, which in turn creates a motive force on the movable contact 12, causing the contact 12 to move towards the closed position.

Typically, the circuit 40 includes one or more storage capacitors 44, 46 for energising the coil 36. In particular, the coil 36 is energised by discharging the capacitor voltage across the coil, thereby causing current to flow through the coil to energise the coil. To this end, the circuit 40 includes one or more switches for selectably applying the or each capacitor voltage to the coil 36. In preferred embodiments, a respective one or more capacitors are provided for opening the actuator 18 and for closing the actuator 18. In FIG. 1, the voltage stored by capacitor 44 is used to close the actuator 18, while the voltage stored by capacitor 46 is used to open the actuator 18 (and therefore to trip the circuit breaker 10). A respective switching device 48, 50 is provided for selectably applying the respective capacitor voltage to the coil 36, the switching devices being controlled by controller 42. The switching devices 48, 50 may take any suitable form but conveniently comprise one or more transistors. In the preferred embodiment, each switching device 48, 50 comprises a respective two transistors arranged as a transistor bridge. Typically, the circuit 40 is arranged such that the respective voltages of the capacitors 44, 46 are applied to the coil 36 with opposite polarity (to create respective currents in the coil with opposite polarity). The voltages applied to the coil 36 by discharging the respective capacitors 44, 46 are transient and have a respective profile (over time) that is determined by the respective capacitance, and typically also on the associated resistance of the circuitry by which the voltage is discharged.

Closing the actuator 18 consumes much more energy than opening the actuator 18 especially where the bias of the spring 26 must be overcome. One way of controlling the closing process involves direct connection of the respective capacitor 44, 46 to the actuator coil 36 for a limited duration (i.e. application of a transient voltage). A disadvantage of this method is the substantial energy required for actuator closing. This energy could be reduced if there were no limitation on the speed at which the actuator closes, since with increasing closing speed actuator efficiency increases. However, closing velocity should be limited in order to preserve the mechanical life of the circuit breaker 10. For example, the closing velocity of the movable contact 12 should typically not exceed 1-1.5 m/s. Therefore, the parameters of the actuator are selected in such a way that the closing velocity does not exceed the acceptable limit. However, in this case the actuator operates with relatively low efficiency, resulting in increased weight, size and power consumption.

Figure 5A:
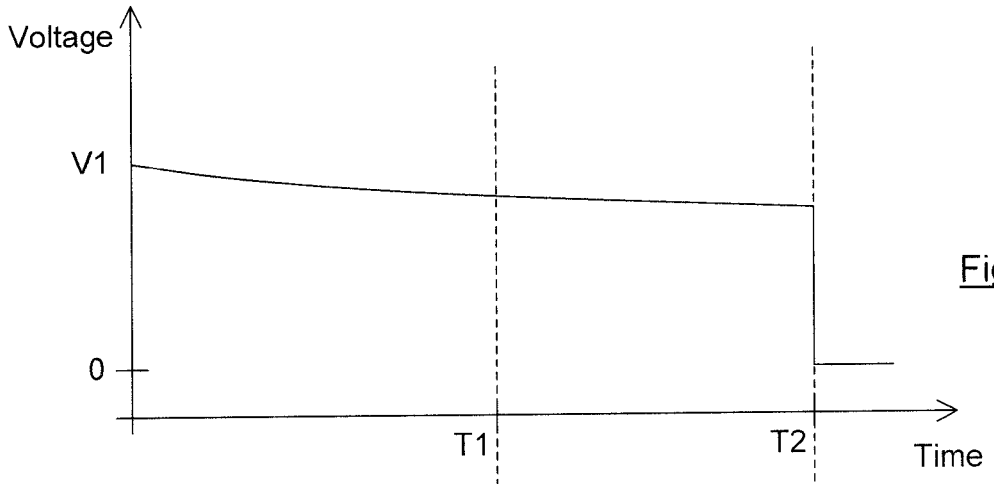
FIG. 5A is a graph showing actuator coil voltage against time for a simple control method.
Figure 5B:
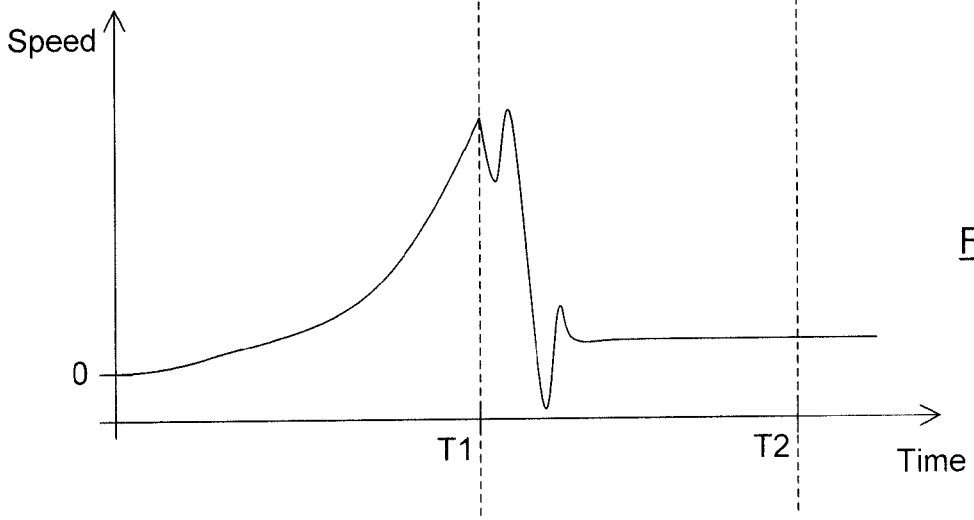
FIG. 5B is a graph showing contact speed against time for the simple control method.

For example, FIG. 5A illustrates the control method described above where the capacitor voltage is applied to the coil 36 via switch 48 in the relatively uncontrolled manner described above. It will be seen that the voltage applied to the coil 36 takes an initial value V1 and is present for a limited period ending at time T2, during which the applied voltage level decays. FIG. 5B is a graph showing how the speed of the movable contact 12 varies over the same period in response to the applied capacitor voltage. It can be seen that the contact speed grows roughly exponentially from zero during the closing process until closure occurs at time T1<T2. To prevent the contact speed from exceeding an acceptable level (assumed to be approximately 1 m/s in this example), the capacitor 44 is selected such that V1 is relatively reduced at approximately 200V. The required capacitor value is relatively high at 2.5 mF in this example, the contact closing time is relatively long (approximately 24 ms in this example) and the total duration of the closing process (including magnetization time) is relatively long at approximately 50 ms in this example.

In preferred embodiments, the controller 42 is configured to control the application of voltage to the coil 36 during the closing process as is now described with reference to FIGS. 6 to 9. In an initial stage where the movable part 24A of the actuator 18 is in its open position (and the contact 12 is in its open position), a voltage V1 is applied to the coil 36 from capacitor 44 for a time period P1 ending at time T3, which is before the contact 12 reaches its closed position. Voltage V1 tends to decrease relatively slowly as the capacitor 44 discharges. During P1, the coil 36 is energised to create a motive force on the movable part 24A of the actuator 18 causing it to move towards its closed position, which in turn creates a motive force on the movable contact 12 causing it to move towards its closed position. Hence, during period P1, the movable contact 12 is accelerated to an initial speed (which may alternatively be referred to as an initial velocity since the contact 12 typically moves substantially linearly towards contact 14). Normally, the movable part 24A and the movable contact 12 are stationary at the beginning of the period P1, i.e. at time T=0.

At the end of time period P1, the controller 42 is configured to adjust the voltage applied to the coil 36, preferably for a second time period P2 ending at time T4, where T4 is before or substantially at the same time as the contact 12 reaches its closed position. The adjustment of the voltage is such that it reduces the motive force exerted on, and therefore the acceleration of, the movable part 24A (by de-energisation of the coil 36) and correspondingly on the movable contact 12.

Figure 6A:
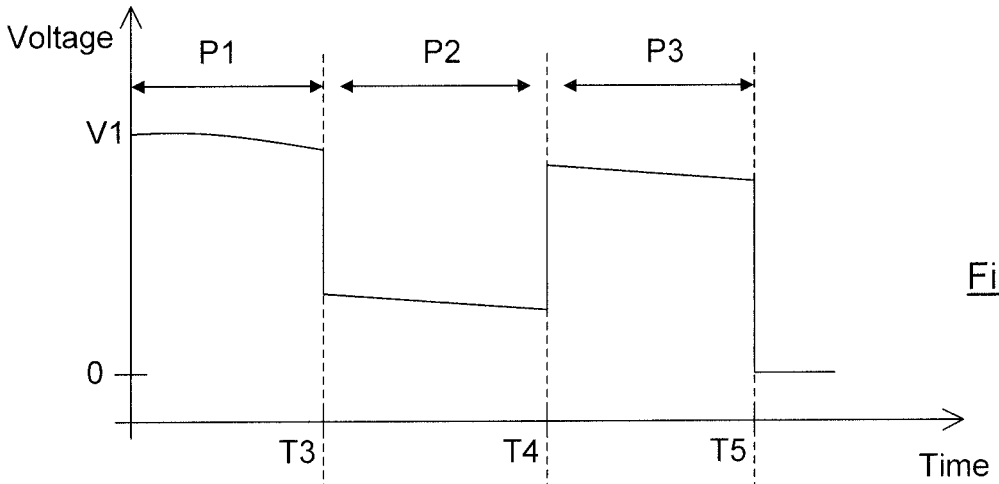
FIG. 6A is a graph showing actuator coil voltage against time for a first control method embodying the invention.

In one embodiment, as exemplified by FIG. 6A, the voltage applied to the coil 36 is reduced at the end of P1 to a non-zero level that is lower than the available capacitor voltage, preferably between zero volts and, for example, approximately 50% of V1 or of the available capacitor voltage at that time. This may be achieved by any suitable means, for example providing control circuit 40 with voltage dividing circuitry (not shown) controllable by controller 42 so that it may selectably cause all or part of the capacitor voltage to the coil 36, or by the provision of pulse width modulation circuitry (not shown).

Figure 7A:
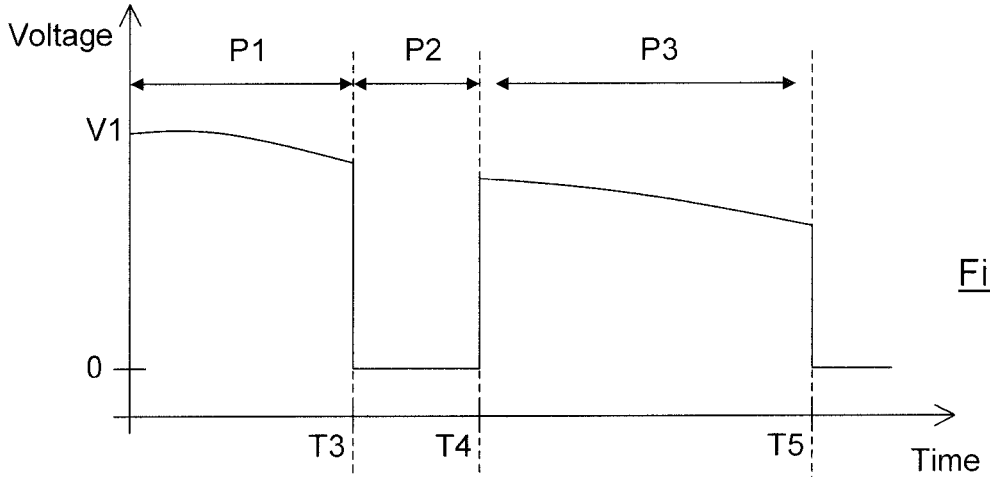
FIG. 7A is a graph showing actuator coil voltage against time for a second control method embodying the invention.
Figure 7B:
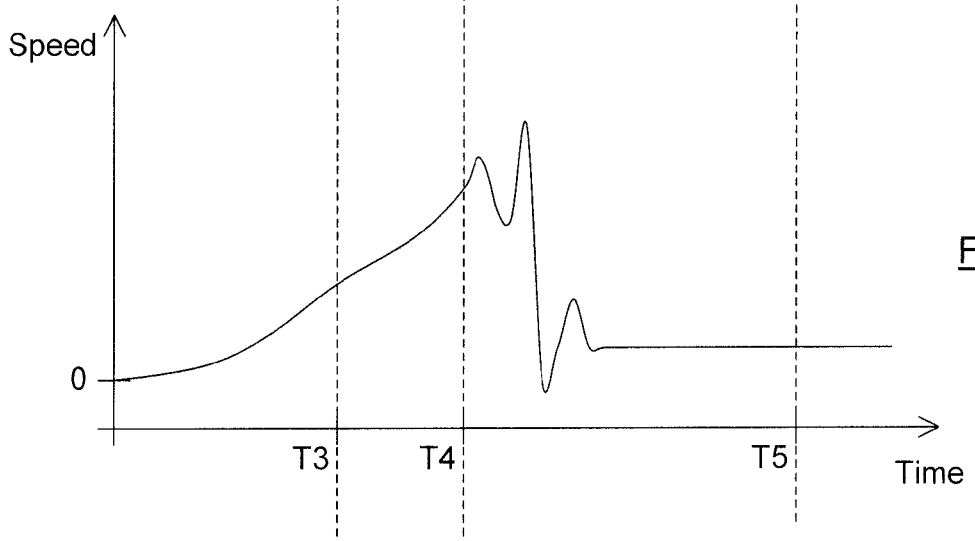
FIG. 7B is a graph showing contact speed against time for said second embodiment.

In another embodiment, as exemplified by FIG. 7A, the voltage applied to the coil 36 is reduced at the end of P1 to zero. Conveniently, the controller 42 may effect this by operating switch 48 to isolate the coil from the voltage across capacitor 44.

Figure 8A:
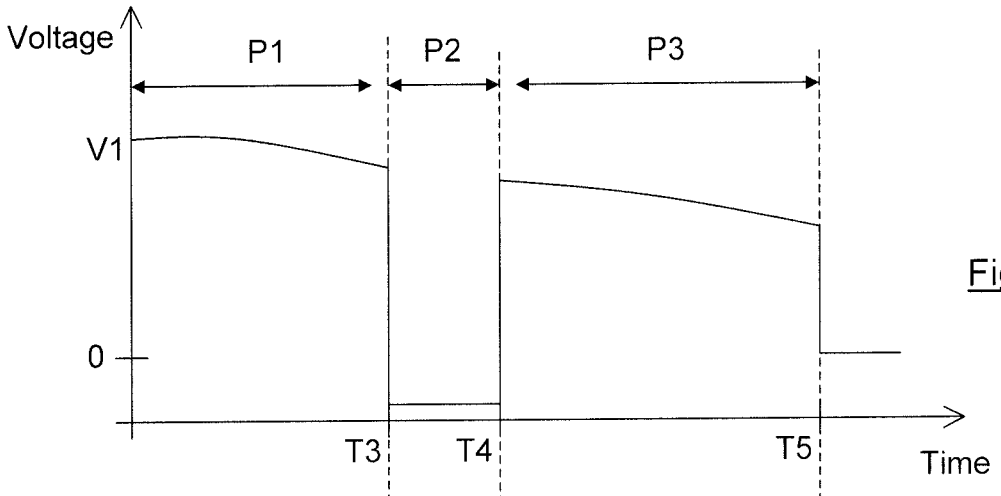
FIG. 8A is a graph showing actuator coil voltage against time for a third control method embodying the invention.
Figure 8B:
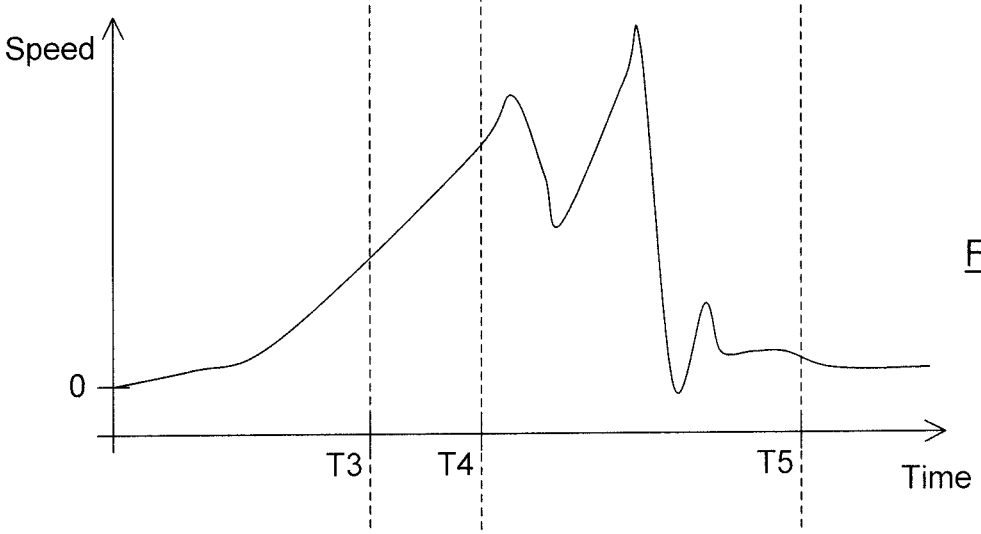
FIG. 8B is a graph showing contact speed against time for said third embodiment.

In a further embodiment, as exemplified by FIG. 8A, the voltage applied to the coil 36 at the end of P1 has a reversed polarity, i.e. a negative voltage value, with respect to the capacitor voltage. This may be achieved by any convenient means. For example, the controller 42 may operate switch 50 to apply a voltage across the coil 36 from capacitor 46, which in preferred embodiments has a polarity opposite that of the capacitor 44 (advantageously, the controller 42 operates switch 48 to isolate capacitor 44 in this case).

Figure 9A:
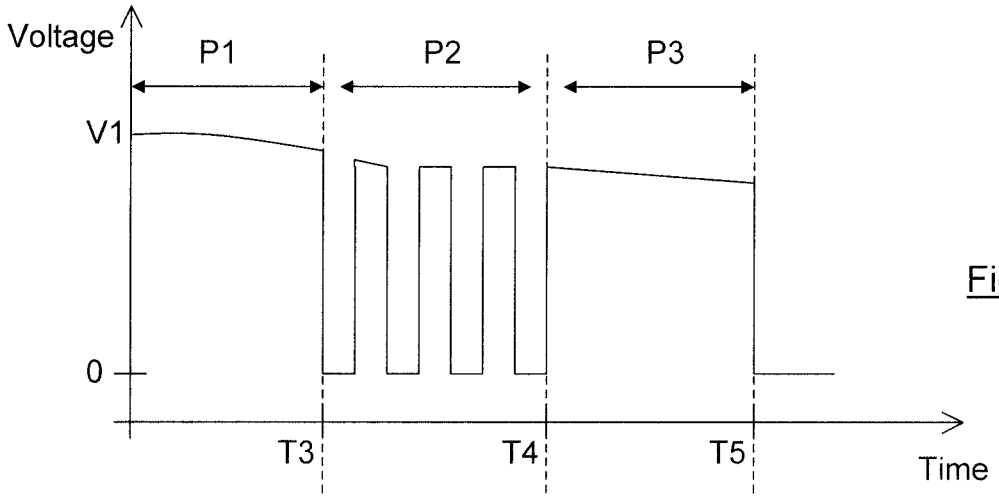
FIG. 9A is a graph showing actuator coil voltage against time for a fourth control method embodying the invention.
Figure 9B:
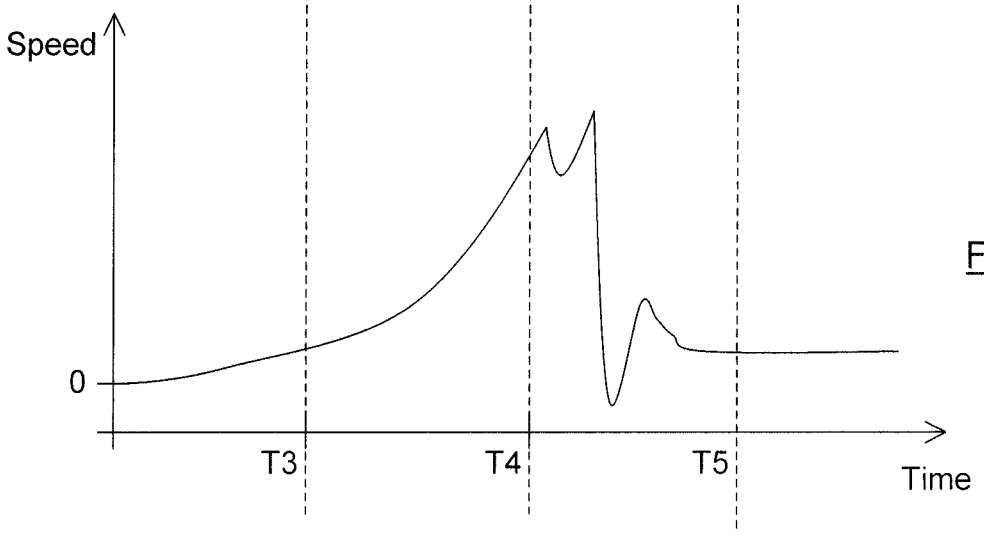
FIG. 9B is a graph showing contact speed against time for said fourth embodiment.

In a still further embodiment, as exemplified by FIG. 9A, the voltage applied to the coil 36 at the end of P1 is modulated, preferably pulse width modulated, and more preferably modulated between zero and the maximum available capacitor voltage. This may be achieved by any suitable means, for example providing control circuit 40 with voltage modulation circuitry (not shown) controllable by controller 42 so that it may selectably cause modulation of the capacitor voltage to the coil 36.

Advantageously, at the end of time period P2, the controller 42 is configured to increase the voltage (including the option of increasing the effective voltage, e.g. by adjusting the modulation) applied to the coil 36, preferably to the maximum level attainable by the control circuit 40 (which in the present embodiment is determined by the voltage across capacitor 44 and is typically less than the voltage V1), for a time period P3 ending at time T5, where T5 typically ends after contact 12 has reached the closed position. This has the effect of re-energising the coil 36 to create sufficient residual magnetism in parts 24A, 24B to hold the actuator 18 in its closed state after the capacitor voltage has gone. In the illustrated embodiment, the voltage is increased during P3 to increase the current in coil 36 in order to increase the magnetic flux in parts 24A, 24B to such a level that the parts 24A, 24B are held closed by residual magnetism (magnetic latching). In embodiments where residual magnetism is not required to hold the latch in its closing state, increasing the voltage during P3 is not necessary.

Period P3 may begin before (preferably just before, e.g. up to 2 ms, preferably up to 1 ms, and more preferably up to 0.5 ms before), at substantially the same moment as, or after the movable contact 12 reaches its closed position. As a result, increasing the voltage at this time does not appreciably increase the speed of the contact 12.

In preferred embodiments, the desired initial speed of the contact 12 at time T3 is determined by the desired maximum speed of the contact 12 when it engages with the fixed contact 14. The desired maximum speed depends on the physical characteristics of the circuit breaker 10 but in general is selected so as not to cause undue damage to the contacts 12, 14. Once the initial speed is known, the duration of period P1 can be determined. This will depend not only on the physical characteristics of the circuit breaker 10 (e.g. respective masses of the movable parts 24A, 12, strength of the spring 26 etc.) but also on the voltage available from the capacitor 44. It is preferred to accelerate the contact 12 to the initial speed as quickly as possible since this reduces the energy required to do so. Therefore, it is preferred to use a capacitor 44 that allows the highest practicable voltage to be provided to the coil 36. In practice, the control circuit 40 has current limitations and so the capacitor 44 is chosen to provide the highest voltage possible without exceeding the current limitations. For example, in the circuit 40 of FIG. 4, the switching transistors have a current limit that determines the maximum voltage that can be provided to the coil 36 by capacitor 44. Once the capacitor voltage is known, T3 can be calculated. Alternatively, it can be determined empirically.

It will be seen therefore that in the preferred embodiment, the entire available capacitor voltage is applied to the coil 36 during the initial stage P1 to begin to close the actuator 18 and to accelerate the movable contact 12 to the desired initial velocity. Then, the voltage (or effective voltage) is decreased deliberately (as opposed to decreasing as a result of capacitor voltage decay) by the controller 42 to suppress acceleration of the contact 12. When the movable contact 12 approaches the closed position (and there is no time left to accelerate the respective movable parts beyond the desired maximum speed), or afterwards, the voltage is increased again, providing growth of coil current to a level sufficient for effective magnetization of the actuator's components to allow magnetic latching in the closed position.

Figure 6B:
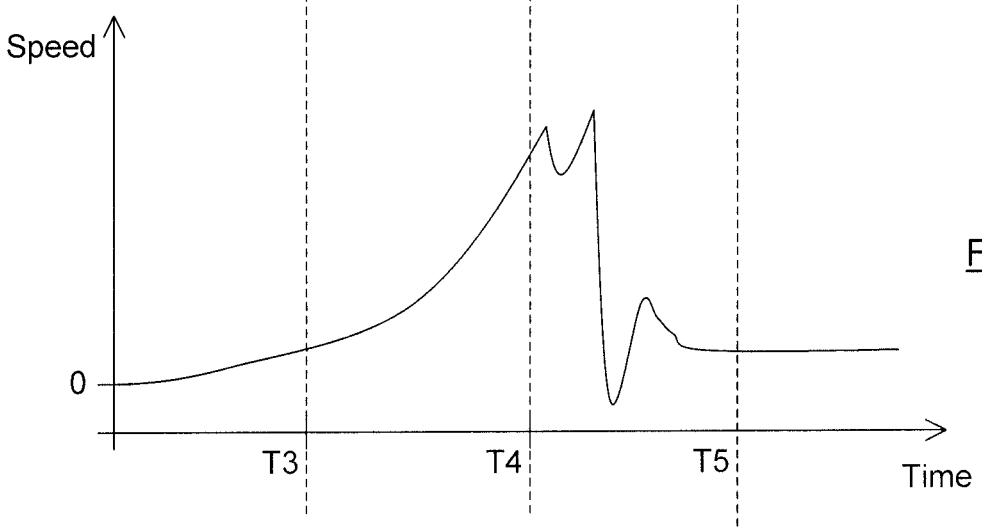
FIG. 6B is a graph showing contact speed against time for said first embodiment.

In the example of FIG. 6, an initial voltage of 385V is applied to the coil 36, then at T3=7 ms the voltage is reduced by approximately 50%. Subsequently, at time T4=16.5 ms the voltage is increased again. As a result, for the same circuit breaker 10, in comparison with the method of FIG. 5, actuator closing time is reduced from 24 ms to 17 ms, total closing time (including latch magnetization time) is reduced from 50 ms to 27 ms and stored energy required for closing is reduced from 50 J to 22 J. Even so, it is noted that the respective closing speeds of the contacts in the examples shown in FIG. 5 and FIG. 6 are substantially the same (approximately 1 m/s).

In practice, the speed of moving contact 12 is important as it affects the mechanical life of the vacuum interrupter or other device. Typically, the respective speeds of movable contact 12 and part 24A of the actuator 18 are substantially equal until movable contact 12 hits the fixed contact 14 (due to the fact that part 24AB during upward movement pushes stem 28 of the insulator 22 with the aid of additional contact pressure spring 27). At the moment when contacts 12, 14 close together, there is a gap, e.g. of approximately 2 mm, between the parts 24A, 24B of the actuator 18. After this moment movable contact 12 does not move but part 24A keeps moving until the gap is closed.

The invention is not limited to the embodiment described herein, which may be modified or varied without departing from the scope of the invention.

The invention claimed is:

1. A method of controlling an electrical switch, the electrical switch comprising a movable electrical contact and an electromagnetic actuator for causing said movable electrical contact to move between an open position and a closed position, a voltage source and a controller for selectably applying voltage from said voltage source to said actuator, said method comprising:

with said movable electrical contact in said open position, causing said controller to apply a voltage from said voltage source to said actuator to cause a motive force to be applied to said movable electrical contact to cause said movable electrical contact to move towards said closed position, wherein said voltage is applied for a first time period ending before said movable contact reaches said closed position, at the end of said first time period, causing said controller to reduce the motive force applied to said movable electrical contact by adjusting said voltage applied to said actuator from said voltage source, calculating a length for said first time period based on a desired initial speed of the movable electrical contact, and causing said controller to accelerate said movable electrical contact to said desired initial speed by applying said voltage for said first time period to accelerate said movable contact to said desired initial speed.

2. The method of claim 1, wherein after said voltage is adjusted to reduce said motive force, causing said controller to increase said motive force on said electrical contact by further adjusting said voltage applied to said actuator from said voltage source.

3. A method as claimed in claim 2, wherein said further adjusting of said voltage is performed before, after, or at substantially the same time as said electrical contact reaches said closed position, a timing being selected such that said further adjusting of said voltage does not substantially affect the speed of said electrical contact.

4. A method as claimed in claim 2, wherein said further adjusting of said voltage is performed before said movable electrical contact reaches said closed position.

5. A method as claimed in claim 4, wherein said further adjusting of said voltage is performed immediately before said movable electrical contact reaches said closed position.

6. A method as claimed in claim 4, wherein said further adjusting of said voltage is performed sufficiently close to the moment when said movable electrical contact reaches said closed position that said further voltage adjusting does not appreciably affect the speed of said movable electrical contact.

7. A method as claimed in claim 5, wherein said further adjusting of said voltage is performed up to 2 ms before said movable electrical contact reaches said closed position.

8. A method as claimed in claim 2, wherein said further adjusting of said voltage is performed substantially at the same time as said movable electrical contact reaches said closed position.

9. A method as claimed in claim 2, wherein said further adjusting of said voltage is performed after said movable electrical contact reaches said closed position.

10. A method as claimed in claim 1, wherein said adjusting said voltage to reduce said motive force involves reducing said voltage to a non-zero level.

11. A method as claimed in claim 10, wherein said adjusting said voltage to reduce said motive force involves reducing said voltage by at least 50% to a non-zero level.

12. A method as claimed in claim 1, wherein said adjusting said voltage to reduce said motive force involves reducing said voltage to zero.

13. A method as claimed in claim 1, wherein said adjusting said voltage to reduce said motive force involves reversing the polarity of said voltage.

14. A method as claimed in claim 1, wherein said adjusting said voltage to reduce said motive force involves modulating said voltage.

15. A method as claimed in claim 14, wherein said adjusting said voltage to reduce said motive force involves pulse width modulating said voltage.

16. A method as claimed in claim 15, wherein said pulse width modulation is arranged to cause zero volts to be applied to said actuator between pulses.

17. A method as claimed in claim 1, wherein said controller comprises a control circuit, said control circuit including said voltage source comprising at least one capacitor for storing said voltage, and wherein said applying a voltage to said actuator to cause a motive force to be applied to said movable contact involves applying said voltage from said at least one capacitor to said actuator.

18. A method as claimed in claim 17, wherein adjusting said voltage to reduce said motive force involves adjusting said voltage applied from said at least one capacitor to said actuator.

19. A method as claimed in claim 1, wherein said actuator comprises at least one electromagnetic coil, and wherein said applying a voltage to said actuator to cause a motive force to be applied to said movable contact involves applying said voltage to said at least one coil.

20. A method as claimed in claim 19, wherein adjusting said voltage to reduce said motive force involves adjusting said voltage applied to said at least one coil.

21. An electrical switch comprising a movable electrical contact and an electromagnetic actuator for causing said electrical movable contact to move between an open position and a closed position, said switch further comprising a voltage source, a controller for selectably applying voltage from said voltage source to said actuator, wherein said controller is arranged to, with said movable electrical contact in said open position, cause a voltage to be applied to said actuator from said voltage source to cause a motive force to be applied to said movable contact to cause said movable electrical contact to move towards said closed position, and wherein said controller is arranged to apply said voltage for a first time period ending before said movable contact reaches said closed position, and wherein said controller is further arranged to, at the end of said first time period, adjust said voltage applied to said actuator from said voltage source to reduce said motive force, said controller being arranged to calculate a length for said first time period based on a desired initial speed of the movable electrical contact, and to cause said controller to accelerate said movable electrical contact to said desired initial speed by applying said voltage for said first time period to accelerate said movable contact to said desired initial speed.

22. A switch as claimed in claim 21, wherein said voltage source comprises at least one capacitor.

23. A switch as claimed in claim 21, wherein said actuator comprises at least one electromagnetic coil, said controller being arranged to selectably apply voltage to said at least one electromagnetic coil.

24. A switch as claimed in claim 23, wherein said actuator includes a movable part movable into and out of a closed position in response to changes in the energization of said at least one electromagnetic coil.

25. A switch as claimed in claim 24, wherein said actuator includes a non-movable part, and wherein said movable and non-movable parts are configured to latch magnetically with one another in a closed position as a result of residual magnetism in said movable and non-movable parts.

26. A switch as claimed in claim 21, wherein said electrical switch comprises a circuit breaker.

27. A switch as claimed in claim 21, wherein said electrical switch comprises a vacuum interrupter.

28. A method as claimed in claim 7, wherein said further adjusting of said voltage is performed up to 1 ms before said movable contact reaches said closed position.

29. A method as claimed in claim 7, wherein said further adjusting of said voltage is performed up to 0.5 ms before said movable contact reaches said closed position.

30. A method as claimed in claim 1, wherein said adjusting said voltage involves adjusting the level of said voltage.

31. The method of claim 1, wherein said desired initial speed is determined by a desired maximum speed of the movable contact.

32. The method of claim 1 wherein said desired initial speed is determined by a desired maximum speed of the movable contact when it reaches said closed position.

33. A method of controlling an electrical switch, the electrical switch comprising a movable electrical contact and an electromagnetic actuator for causing said movable electrical contact to move between an open position and a closed position, a voltage source and a controller for selectively applying voltage from said voltage source to said actuator, said method comprising:

with said movable electrical contact in said open position, causing said controller to apply a voltage from said voltage source to said actuator to cause a motive force to be applied to said movable electrical contact to cause said movable electrical contact to move towards said closed position, wherein said voltage is applied for a first time period ending before said movable electrical contact reaches said closed position, and at the end of said first time period, causing said controller to reduce said motive force on said electrical contact by adjusting said voltage applied to said actuator from said voltage source, and wherein after said voltage is adjusted to reduce said motive force, causing said controller to increase said motive force on said electrical contact by further adjusting said voltage applied to said actuator from said voltage source, and wherein said adjusting said voltage to reduce said motive force involves reversing the polarity of said voltage.

* * * * *